United States Patent [19]

Bartel

[11] 4,139,340

[45] Feb. 13, 1979

[54] KILN HEAT EXCHANGER

[76] Inventor: Marvin Bartel, 1708 Lincolnway East, Goshen, Ind. 46526

[21] Appl. No.: 815,592

[22] Filed: Jul. 14, 1977

[51] Int. Cl.[2] ..... F27D 17/00

[52] U.S. Cl. ..... 432/179; 432/223

[58] Field of Search ..... 432/179, 223

[56] References Cited

U.S. PATENT DOCUMENTS

| | | | |
|---|---|---|---|
| 1,152,828 | 9/1915 | Mathews | 432/179 |
| 1,619,747 | 3/1927 | Morton | 432/179 |
| 3,476,368 | 11/1969 | Saiki | 432/179 |
| 4,029,465 | 6/1977 | Le Haye et al. | 432/223 |

*Primary Examiner*—John J. Camby
*Attorney, Agent, or Firm*—Olson, Trexler, Wolters, Bushnell & Fosse, Ltd.

[57] ABSTRACT

A heat exchanger for use with a pottery kiln or the like includes a plurality of tubes for carrying air aligned by and arrayed in groups in a vertical array from the cool end to the hot end of the flue of the kiln. Connecting passageways are provided vertically between successive groups of tubes, for directing air from each group of tubes through the next hotter group, to heat the air gradually and in stages as it passes therethrough. As many sets of progressively hotter tubes may be used as required for raising the air therein to a desired temperature. Also, the number and size of tubes may vary overall as well as from group to group, according to the size of kiln and temperature to which the air is to be raised. The final group of tubes is provided with a connection to the combustion chamber of the kiln for mixing therein with fuel to provide flame to the firing chamber thereof. A blower is provided at the inlet of the first group of tubes for moving the air downward through the tubes to be heated and to confine mixing of air and fuel and combustion thereof to the combustion chamber.

9 Claims, 4 Drawing Figures

10
18
102
104
44
48
62
64
55
100
30
98
28
52
56
54
42
46
50
26
40
2
51
58
70
66
68
80
76
88
78
86
84
72
60
57
22
74
90
82
92
94
96
24
63
16
36
32
34
38
20

KILN HEAT EXCHANGER

BACKGROUND OF THE INVENTION

This invention relates generally to a heat exchanger, and more particularly to a heat exchanger for use with a kiln or the like for raising the temperature of combustion air by utilizing the heat of the exhaust flue of the kiln.

While a heat exchanger according to this invention is useful in a variety of applications, the description will be facilitated by addressing the problem of providing a heat exchanger for application to high temperature pottery kilns of the type generally used by studio potters, schools, laboratories, hobby ceramists, clay product factories and pottery factories.

In a typical kiln, the heat from spent exhaust gases is essentially wasted as it simply exits the flue and goes up a chimney or the like. Thus, increased fuel efficiency is possible if this waste heat can be utilized to pre-heat combustion air. In this way, a larger percentage of the heat energy of combustion is utilized in raising the temperature of the product being fired and a correspondingly smaller percentage of the energy is required to raise the temperature of the air entering the combustion chamber.

A number of problems arise in attempting to utilize the heat of exhaust gases in this fashion, and devices known to the prior art have generally failed to solve these problems and to maximize fuel efficiency. For example, for maximum efficiency it is desirable to heat the air for combustion to as close to the temperature of the firing chamber as possible. However, in high temperature pottery kilns, this temperature is typically in excess of 2000° F., but the materials used in many prior art devices are not suitable for withstanding such high temperatures. Additionally, to attain such a high air temperature, it is necessary for the air to be in thermal contact with the hot exhaust gases of the flue, for a substantial amount of time, over a substantial area, or both. In contrast, many prior art devices provide only relatively short pipes or the like in contact with flue gases, whereby it is impossible to attain the high temperatures required for maximum efficiency in pottery kilns of the type mentioned. Also, it is necessary to confine combustion of the fuel and air entirely to the combustion chamber of the kiln, and prevent fuel from mixing with the heated air prior to the air reaching the combustion chamber, to prevent ignition or combustion thereof in the air carrying tubes or the like prior to reaching the combustion chamber. Further, to obtain the required heating of the air, it is necessary to provide thermal contact between the air carrying conduits or the like and the flue not only in the relatively cooler portions of the flue, but also in the hotter portions thereof, extending as close as possible to the hottest end thereof, which communicates with the firing chamber. Again, many prior art devices utilize materials not suitable for this type of an arrangement.

OBJECTS AND SUMMARY OF THE INVENTION

Accordingly, it is a general object of this invention to provide a heat exchanger for use with a kiln or the like, for utilizing spent exhaust gases therefrom to pre-heat combustion air as close as possible to the temperature of the firing chamber thereof, for maximum fuel efficiency.

A more specific object of the present invention is to provide a heat exchanger in accordance with the foregoing object, further adapted to prevent fuel and air from mixing except in the combustion chamber of the kiln, thereby preventing preignition or combustion in any portion of the heat exchanger itself or of the flue of the kiln.

Yet another object of this invention is to provide a heat exchanger in accordance with the foregoing objects, which is adapted to move air in thermal contact with the flue gases, substantially from the coolest end of the flue to the hottest end thereof, maintaining sufficient contact area for raising the temperature of the air in a gradual fashion as it passes therethrough.

Briefly, a heat exchanger for a pottery kiln, in accordance with this invention, comprises air passageway means in thermal contact with flue means of the kiln. The passageway means include air inlet means adjacent the cooler end of the flue means and air outlet means adjacent the hotter end of the flue and connected with the combustion chamber of the kiln for providing heated air theretofor combustion with fuel therein. Blower means are provided at the air inlet means for delivering air through the passageway means to the combustion chamber for confining the mixing of air and fuel and combustion thereof to the combustion chamber.

In a preferred embodiment, hood means are provided attached above a top wall of the firing chamber of the kiln for collecting warm air therefrom, and a blower is mounted an intake thereof connected with the hood means and an outlet connected with air inlet of the passageway means. Also in a preferred embodiment, the passageway means comprises a plurality of tube means extending substantially horizontally across the flue of the kiln, and spaced along the vertical length of the flue and connecting means between adjacent ones of the tube means for heating the air therein substantially in stages as it passes from the cooler to the hotter end of the flue.

Other objects, features and advantages of this invention will be more readily appreciated upon consideration of the following detailed description together with the accompanying drawings, wherein like reference numerals are used throughout to designate like elements and components.

DETAILED DESCRIPTION OF THE ILLUSTRATED EMBODIMENT

Figure 2:
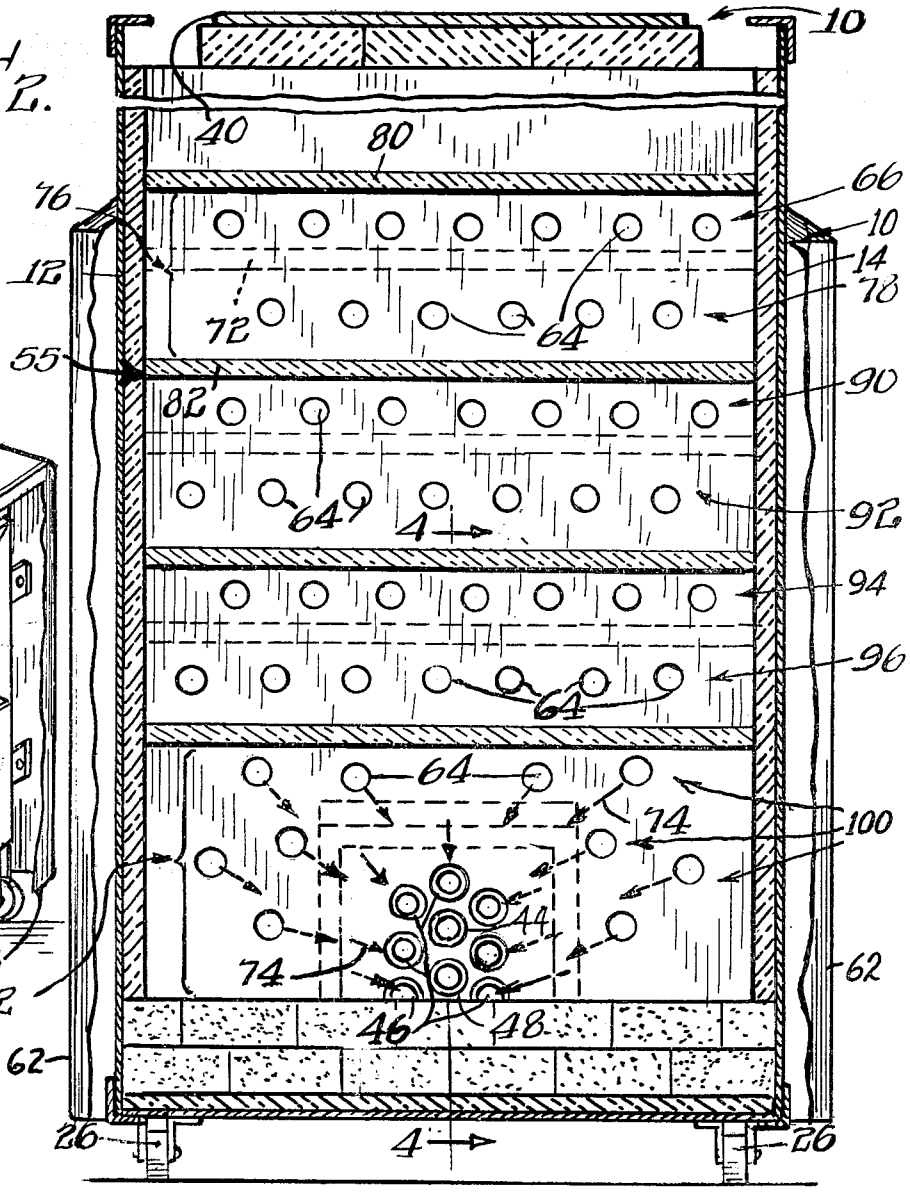
FIG. 2 is a sectional view taken generally along the line 2—2 of FIG. 1.
Figure 1:
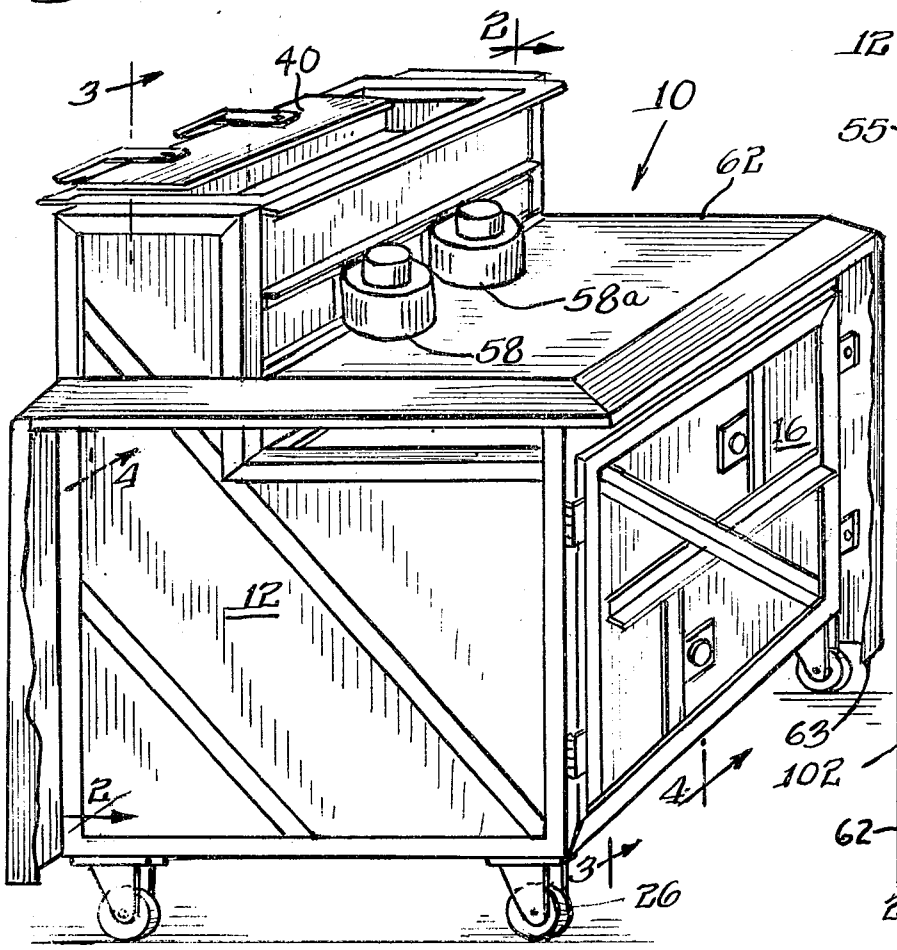
FIG. 1 is a perspective view of a pottery kiln including a heat exchanger, constructed in accordance with this invention.

Referring to the drawings, a pottery kiln 10 includes exterior side walls 12 and 14, a front door 16, a back wall 18, a floor or bottom 20 and a top 22, constructed of suitable materials, as known in the art. Suitable interior walls, designated generally 24 comprise suitable insulating material for the top, front and sides, such as high temperature fiber board insulation, as known in the art. Wheels 26 are provided, attached to the bottom of the kiln 10. While the kiln illustrated for purposes of describing the invention is a relatively small portable type kiln, the invention is not limited thereto, but is applicable to larger kilns as well.

Figures 3, 4:
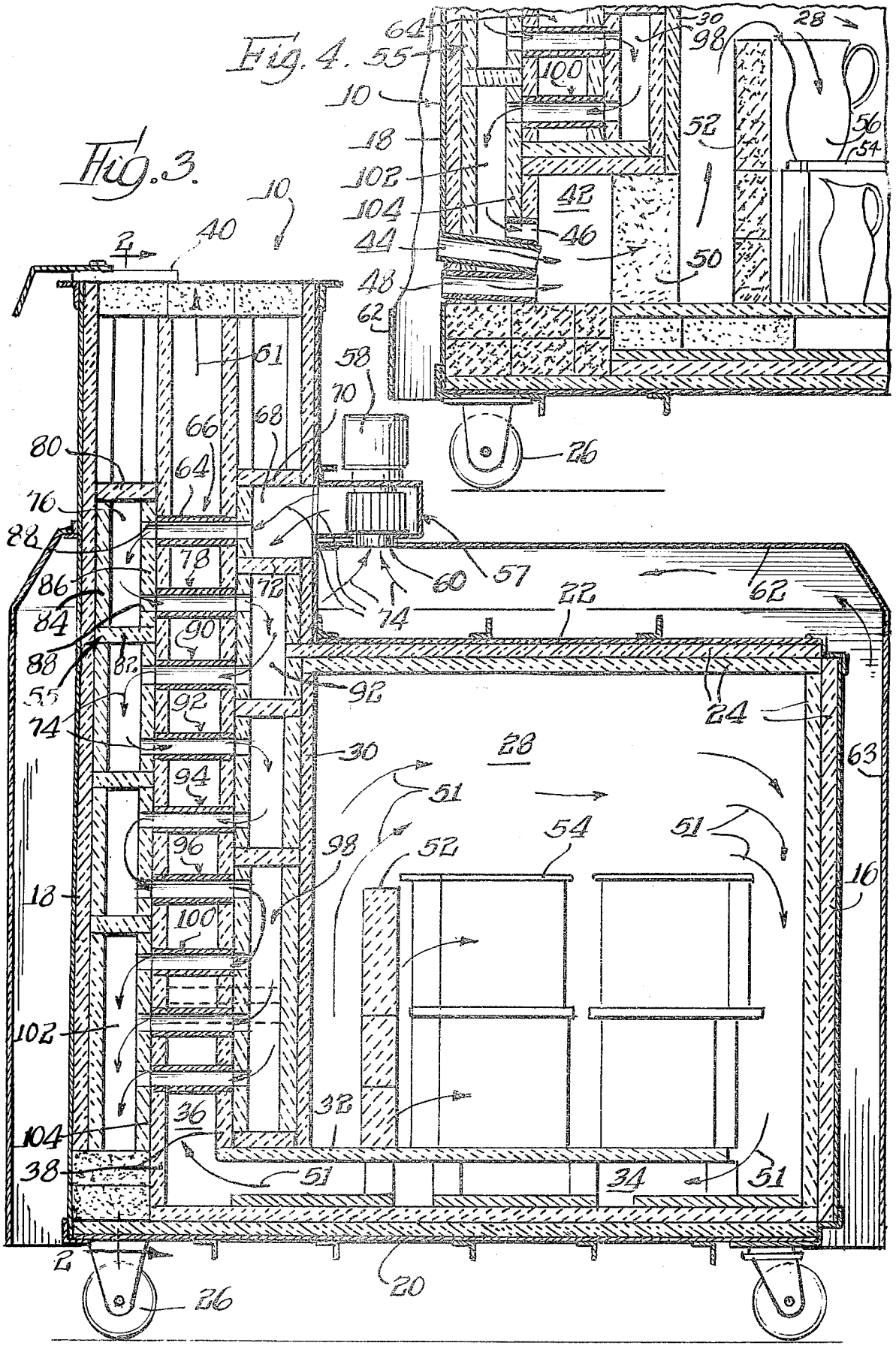
FIG. 3 is a sectional view taken generally along the line 3—3 of FIG. 1.
FIG. 4 is a sectional view, partially cut-away, taken generally along the line 4—4 of FIG. 1.

As best seen in FIGS. 3 and 4, the kiln 10 includes a firing chamber 28, generally defined by the interior front, top and side walls 24 by an interior back wall 30, which is also preferably constructed of suitable high temperature fiber board material. An interior floor member 32, also preferably of suitable high temperature fiber board material, is spaced above the interior side of the bottom wall 20, to define a horizontal opening 34 beneath the firing chamber 28, which comprises a portion of a flue therefor. The flue portion or opening 34 extends generally horizontally beneath the firing chamber 28 and is connected to an elongate vertically extending flue portion or chimney 36, spaced apart from and located generally behind the wall 30 of the firing chamber 28. The vertically extending flue portion or chimney 36 is lined with suitable high temperature fiber board insulation material 38. A suitable damper 40 is provided at the top or outlet of the vertical flue or chimney 36, and comprises a solid plate selectively movable across the top opening thereof to define the size of a top opening thereof, as known in the art. The kiln 10 also includes a combustion chamber 42 connected with the firing chamber 28, and including a fuel inlet 44, an air inlet 46, and a suitable safety device 48 to insure proper combustion therein. The combustion chamber 42 communicates with the firing chamber 28 for providing flame thereto for firing pottery therein, and includes a target brick 50, for facilitating combustion and ignition of fuel and air therein, as known in the art. Thus, the arrangement of the combustion chamber 42, the firing chamber 28 and the flue portions 34 and 36 define a downdraft configuration of the kiln 10, the direction of the products of combustion being indicated generally by arrows 51. The firing chamber 28 also includes a bag wall 52 to aid in proper distribution of heat therein, as known in the art, and suitable shelves or partitions, designated generally 54 for holding pottery 56 to be fired, as best seen in FIGS. 3 and 4.

A heat exchanger designated generally 55 is in thermal contact with the vertical flue portion or chimney 36, substantially from the cooler or upper end thereof to the hotter or lower end thereof, for providing hot air via the inlet 46 to the combustion chamber 42 to facilitate efficient combustion of air and fuel therein. As best seen in FIG. 3, air inlet means 57 of the heat exchanger including a blower 58 provides air thereto at the cooler or upper end of the vertical flue or chimney 36. The blower 58 has an air intake portion 60 positioned, in the illustrated embodiment, over the top wall 22 of the firing chamber 22 of the kiln 10. In a preferred embodiment, a second blower 58*a*, of identical structure and having the same function as the blower 58, is included. While a downdraft configuration is illustrated herein, it will be appreciated that the heat exchanger of this invention is equally applicable to other draft configurations. Also in a preferred embodiment, a hood 62 is provided spaced apart from the top 22, and from the side and back walls 12, 14, 18 of the kiln 10 and extending substantially over the entire surfaces thereof. The hood 62 also includes removable front panel 63, extending over the door 16 of the kiln 10. Also in a preferred embodiment, the hood 62 and front panel 63 thereof are provided with a reflective inner surface. The air intake 60 of the blower is connected with the top of the hood 62 which collects the relatively warm air rising from the exterior of the kiln 10 and provides said warm air to the blower 58. Thus, improved efficiency in heating air in the heat exchanger 55 is obtained over the case where cooler ambient air is introduced thereto.

The heat exchanger 55 includes a plurality of tubes 64 of substantially identical length, arranged generally horizontally across the vertical flue or chimney 36 in a vertical array. The tubes 64 preferably comprise a high alumina clay such as mulite for withstanding the relatively high temperatures of the exhaust gases in the flue 36 and for heating the air passing therethrough to correspondingly high temperatures without damage or deformation. The heat exchanger tubes 64 are arranged in groups, the tubes of each group occupying substantially the same vertical level. In the illustrated embodiment, a first group 66 of tubes 64 has its relatively cooler side connected with the inlet means 57, including an outlet of the blower 58, at a chamber or passageway 68 provided therefor. The chamber or passageway 68 is generally defined by top and bottom walls or partitions 70 and 72 preferably comprising a high temperature fiber board material similar to that of the insulating walls 24 described above. The direction of air movement through the heat exchanger 55 is indicated by arrows designated generally 74. Air having passed through the first group 66 of tubes 64, a second passageway or chamber 76 is provided connected with the relatively hotter end thereof, and with the relatively cooler end of a second group of tubes designated generally 78 disposed below the group 66. The chamber 76 is defined by a top wall 80, a bottom wall 82, and side walls 84 and 86 preferably comprising high temperature fiber board material similar to that of the chamber or passageway 68. It will be noted that the side wall 86 includes a number of openings 88 therein for receiving the tubes 64 of the groups 66 and 78, respectively. Similarly, a third group 90 of the tubes 64 is provided disposed below the group 78, the relatively cooler ends thereof being connected with the relatively hotter ends of the tubes 64 of the group 78 by a chamber or passageway 92, similar to the chamber or passageway 76. The chamber or passageway 92 is generally below the chamber or passageway 68, the bottom wall 72 thereof defining a top wall of the chamber 92 which also includes a bottom wall and side walls, one side wall thereof being provided with suitable openings for receiving the tubes 64 of the groups 78 and 90, similar to the chamber or passsageway 76. In similar fashion, succeeding groups 92, 94 and 96 of tubes 64 are provided at succeeding levels of the vertical array, the relatively hotter end of each group being connected with the relatively cooler end of the next succeeding group by a chamber or passageway similar to the chambers or passageways 76 and 92. Thus, the air flow is directed by the tubes and connecting chambers or passageways substantially back and forth across the vertical flue or chimney 36, as indicated by the arrows 74.

The last group 96 of tubes 64 in the vertical array has its relatively hotter end connected with a passageway or chamber 98 which is also connected with the relatively cooler end of a last group 100 of tubes 64. The tubes 64 of the group 100 are disposed in the flue 36 generally about the top and sides of the combustion chamber 42, the relatively hotter ends thereof being connected by a passageway or chamber 102 with the air inlet 46 of the combustion chamber 42, which inlet preferably comprises a plurality of openings formed in a side wall 104 of the chamber or passageway 102.

Thus, the air is heated, as indicated by the arrows 74, substantially in stages as it passes through the successive groups of tubes 64 from the cool end to the hot end of the vertical flue or chimney 36. As the bottom or hotter end of the chimney 36 communicates via the horizontal flue portion 34 with the firing chamber 28, it will be appreciated that the temperature of the exhaust gases thereat will be substantially similar to the temperature of the interior of the firing chamber 28. Thus, the air heated in the tubes 64 will approach the same temperature by the time it reaches the air inlet 46 of the combustion chamber 42. It will be appreciated that a larger percentage of the heat energy of combustion is utilized in raising the temperature of the product being fired in the firing chamber 28, and a smaller percentage being lost as exhaust gases. With the exhaust gases being used to preheat the air for combustion in this manner, a correspondingly smaller percentage of energy is required to raise the temperature of the air in the combustion chamber 42 to a temperature suitable for combustion therein.

While a preferred embodiment has been shown and described herein it will be appreciated that the number and size of tubes 64 may vary overall as well as from group to group according to the type of kiln and temperature to which the air is to be raised. Also, as many sets of progressively hotter tubes may be used as required for a particular application. Further, obvious modifications may be made to the illustrated embodiment whereby the exhaust exits via the horizontally crossing tubes 64 and the air for combustion is passed through the vertical chamber 36 surrounding the tubes 64 to be heated. Therefore, the invention is not limited to the embodiment shown and described herein. Changes in form and proportion of parts, as well as such other changes and modifications as may occur to those skilled in the art are to be understood as forming a part of this invention insofar as they fall within the spirit and scope of the appended claims.

The invention is claimed as follows:

1. A pottery kiln comprising a firing chamber, a combustion chamber including fuel supply means and air supply means and connected with said firing chamber for providing flame thereto, first means comprising flue means having a hot end thereof communicating with said firing chamber and a cool end communicating with outside air for providing a draft to said firing chamber and for carrying exhaust therefrom, and second means comprising air passageway means in thermal contact with said flue means for heating air in said passageway means, said passageway means including air inlet means adjacent said cool end of said flue means and air outlet means adjacent said hot end of said flue means, said air outlet means comprising said air supply means for said combustion chamber, blower means for moving air through said passageway from said air inlet means to said air outlet means for providing heated air to said combustion chamber to facilitate combustion with said fuel therein and for confining mixing and combustion of said air with fuel to said combustion chamber and wherein one of first and second means includes an elongate substantially vertical chamber and the other of said first and second means includes a plurality of tubular members extending substantially horizontally across said chamber at vertically spaced intervals along its vertical length and means interconnecting vertically adjacent ones of said tubular members for heating said air substantially in stages as it passes in thermal contact with said flue means from said cool end to said hot end of said flue means.

2. A pottery kiln according to claim 1 further including a hood extending over a top wall of said kiln for collecting warm air, and wherein said blower means includes an intake coupled with said hood for receiving said warm air and an outlet connected with said air-inlet of said passageway means for delivering warm air to said passageway means.

3. A pottery kiln according to claim 2 wherein said hood further includes side panels extending over side and back walls of said kiln and a door panel member extending over a door of said firing chamber.

4. A pottery kiln according to claim 1 wherein said vertical chamber comprises the flue means and said tubular members comprise the air passageway means and are arranged substantially horizontally in a plurality of groups, each group crossing said vertical chamber at a predetermined level along the vertical length thereof, to define a generally vertical array of said groups, each having a relatively cooler side and a relatively hotter side, a first of said groups having its cooler side connected with said blower means, and a last one of said groups having its hotter side connected with said combustion chamber, said passageway means including connecting means between the hotter end of each other of said groups and the cooler end of the next succeeding one of said groups, for heating the said air substantially gradually and in stages as it passes through said groups until said air reaches substantially the temperature of said hot end of said flue which corresponds substantially to the temperature of said firing chamber.

5. A pottery kiln according to claim 4 wherein said tubular members comprise a composition of high alumina clay for withstanding the relatively high temperatures in said flue at the outside thereof, and of said air passing inside thereof, substantially without damage or deformation thereto.

6. A pottery kiln according to claim 5 wherein said flue means includes a portion thereof beneath said firing chamber and connecting with said vertical chamber thereof to define a down draft kiln configuration.

7. A heat exchanger for use with a kiln or the like including a combustion chamber, and a firing chamber, said heat exchanger comprising: first means comprising flue means for said combustion chamber and second means comprising air passageway means in thermal contact with said flue means and including air inlet means adjacent the cooler end of said flue means and air outlet means adjacent the hotter end of said flue means and communicating with said combustion chamber for providing heated air thereto for combustion with fuel therein, and blower means at said air inlet means for facilitating the movement of air through said passageway means from said air inlet means to said air outlet means and for confining mixing of fuel and air and combustion thereof to said combustion chamber and wherein one of said first and second means comprises an elongate vertical chamber and the other of said first and second means comprised a plurality of substantially horizontally disposed tubular members crossing said vertical chamber at spaced intervals along the vertical length thereof and means interconnecting vertically adjacent ones of said tubular members for heating said air substantially in stages as it passes in thermal contact with said flue means from said cooler end to said hotter end of said flue means.

8. A heat exchanger according to claim 7 wherein said vertical chamber comprises the flue means and said tubular members are arranged in a plurality of groups, each group being disposed in said vertical chamber at a predetermined level along the vertical length thereof to define a vertical array of of said groups, each group having a relatively cooler side and a relatively hotter side, a highest positioned one of said groups in said vertical array having its cooler side connected with said blower to receive air therefrom, a lowest one of said groups in said vertical array having its hotter side connected with said combustion chamber to deliver heated air thereto, and wherein said interconnecting means comprises a plurality of connecting passages, each disposed between the hotter end of one said groups and the cooler end of the next succeeding one of said groups therebelow in said vertical array.

9. A heat exchanger according to claim 8 wherein said tube means comprise tubes composed of high alumina clay for withstanding the temperatures of exhaust gases in said flue means and for heating the air passing therethrough substantially to said temperature, without damage or deformation thereto.

* * * * *

UNITED STATES PATENT AND TRADEMARK OFFICE

CERTIFICATE OF CORRECTION

PATENT NO. : 4,139,340

DATED : February 13, 1979

INVENTOR(S) : Marvin Bartel

It is certified that error appears in the above-identified patent and that said Letters Patent are hereby corrected as shown below:

Column 8, line 8, change "tube means" to --tubular members--.

Signed and Sealed this

*Tenth* Day of *July 1979*

[SEAL]

*Attest:*

*Attesting Officer*

LUTRELLE F. PARKER

*Acting Commissioner of Patents and Trademarks*